US007052364B2

(12) United States Patent
Zhang et al.

(10) Patent No.: US 7,052,364 B2
(45) Date of Patent: May 30, 2006

(54) REAL TIME POLISHING PROCESS MONITORING

(75) Inventors: Jian Zhang, Aurora, IL (US); Ian W. Wylie, Naperville, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 28 days.

(21) Appl. No.: 10/867,087

(22) Filed: Jun. 14, 2004

(65) Prior Publication Data

US 2005/0277365 A1 Dec. 15, 2005

(51) Int. Cl.
*B24B 49/00* (2006.01)

(52) U.S. Cl. ..... 451/5; 451/8; 451/9; 451/41; 451/288

(58) Field of Classification Search ..... 451/5, 451/8, 9, 36, 41, 63, 288–290, 388; 156/165
See application file for complete search history.

(56) References Cited

U.S. PATENT DOCUMENTS

| | | | | |
|---|---|---|---|---|
| 4,197,676 | A | 4/1980 | Sauerland | |
| 4,199,902 | A | 4/1980 | Sauerland | |
| 4,407,094 | A | 10/1983 | Bennett et al. | |
| 5,099,614 | A * | 3/1992 | Arai et al. | 451/8 |
| 5,483,568 | A * | 1/1996 | Yano et al. | 438/16 |
| 5,575,706 | A * | 11/1996 | Tsai et al. | 438/693 |
| 5,624,300 | A * | 4/1997 | Kishii et al. | 451/36 |
| 5,643,050 | A * | 7/1997 | Chen | 451/10 |
| 5,664,990 | A * | 9/1997 | Adams et al. | 451/60 |
| 5,685,766 | A * | 11/1997 | Mattingly et al. | 451/36 |
| 5,722,875 | A * | 3/1998 | Iwashita et al. | 451/8 |
| 5,836,805 | A | 11/1998 | Obeng | |
| 5,865,666 | A | 2/1999 | Nagahara | |
| 5,904,609 | A | 5/1999 | Fukuroda et al. | |
| 6,007,405 | A | 12/1999 | Mei | |
| 6,010,538 | A | 1/2000 | Sun et al. | |
| 6,015,333 | A | 1/2000 | Obeng | |
| 6,042,454 | A | 3/2000 | Watanabe et al. | |
| 6,077,147 | A | 6/2000 | Yang et al. | |
| 6,080,050 | A * | 6/2000 | Chen et al. | 451/288 |
| 6,293,847 | B1 | 9/2001 | Easter et al. | |
| 6,431,953 | B1 | 8/2002 | Carter et al. | |
| 6,488,569 | B1 | 12/2002 | Wang et al. | |
| 6,520,834 | B1 | 2/2003 | Marshall | |
| 6,558,229 | B1 | 5/2003 | Kimura et al. | |
| 6,561,868 | B1 | 5/2003 | Edwards et al. | |
| 6,634,924 | B1 | 10/2003 | Koji et al. | |

FOREIGN PATENT DOCUMENTS

JP 07-040234 A 2/1995

* cited by examiner

*Primary Examiner*—Lee D. Wilson
*Assistant Examiner*—Anthony Ojini
(74) *Attorney, Agent, or Firm*—Phil Pippenger

(57) ABSTRACT

A technique for in situ monitoring of polishing processes and other material removal processes employs a quartz crystal nanobalance embedded in a wafer carrier. Material removed from the wafer is deposited upon the surface of the crystal. The resulting frequency shift of the crystal gives an indication of the amount of material removed, allowing determination of an instantaneous removal rate as well as a process endpoint. The deposition on the quartz crystal nanobalance may be controlled by an applied bias. Multiple quartz crystal nanobalances may be used. In a further embodiment of the invention, the quartz crystal nanobalance is used to detect defect-causing events, such as a scratches, during the polishing process.

36 Claims, 10 Drawing Sheets

REAL TIME POLISHING PROCESS MONITORING

FIELD OF THE INVENTION

This invention relates generally to polishing techniques, and, more particularly, relates to a system and method for providing real time monitoring of chemical mechanical and other polishing processes.

BACKGROUND

Polishing processes are used in a variety of technologies and for a number of purposes. For many applications, the polish is for aesthetic or mechanical purposes and the microscopic accuracy of the polish is not critical. However, in some applications, such as for processing of electronic materials and/or components, it is important that the polishing process be accurate. For example, an uneven or overly deep polish may ruin some or all of a product, such as a wafer bearing one or more finished or intermediate integrated circuits. On the other hand, an insufficiently deep polish, even if uniform, may render the product unsuitable as well. Accordingly, for many applications, it is necessary that polishing be quite accurate.

A number of prior art methods are available to address this problem. For example, it is known to perform ex situ monitoring of a polishing process. An example of this technique involves removing a piece being polished from the polishing process periodically and using tests to determine the extent and quality of the polish process at that point. Typically this technique is used beforehand to develop a polishing protocol rather than to check each piece during actual production. This assumes a great degree of consistency and control with respect to the polish process parameters.

Moreover, such techniques are expensive, slow, and can be inexact. The expense and slowness arise due to the need to perform multiple experiments and to repeatedly start and stop the polishing process. The inexact nature of this technique is due to the fact that often no appropriate measurement or monitoring occurs during the actual process of interest, i.e. during the production process. Thus, variations in any number of factors may affect the polish rate and/or quality without any ability to detect and correct such variations in real time.

A technique sometimes used to detect the endpoint of an ongoing polishing step involves the monitoring of the frictional force between the wafer and a polishing pad. When the frictional force changes suddenly, it is assumed that the previous layer has been removed, and that a new layer, with a different frictional coefficient, has been exposed. However, this procedure assumes that the materials involved have significantly different frictional coefficients. Moreover, even if the frictional coefficients are substantially different from one another, it is still often challenging to detect the small changes in force. On the whole, the practicality and accuracy of this technique are lacking.

A more common technique for in situ surface analysis involves laser interferometry. Using this technique, a hole or window is typically placed in the polishing pad and laser radiation is directed through the window onto the polished surface. The reflection of the laser radiation from the polished surface is collected and analyzed to determine the thickness of the top layer. The reflected light will typically comprise a component that has penetrated the surface before reflecting as well as a component that has reflected from the surface without penetrating. The path difference between these components yields an oscillating (interference) pattern in the collected reflection, which can then be processed to track the layer thickness.

This technique, while somewhat effective, has a number of shortcomings. For example, since the technique requires that a hole be made in the polishing pad, the possibility of leakage, and consequent disruption of the polishing process, is increased. Moreover, the technique can only be used to analyze an entire layer with all of its components, and cannot be used to analyze just one of multiple surface constituents. Furthermore, since the pad is often rotating or oscillating, it is only possible to obtain an intermittent interferometric reading. This is especially troublesome near the end of a polishing process, when a lag on the order of a second or so may be important. In addition, the presence of the hole in the polishing pad can alter the behavior of the polishing action. Finally, interferometric measurements can become unreliable towards the end of a polishing step as the layer under analysis becomes infinitely thin.

As a result of the deficiencies in existing techniques, the rate of defective products is higher, resulting in lower yield and higher cost, than would be attainable if an effective in situ monitoring process were available. Moreover, the development of new polishing procedures would be faster and more efficient if a practical in situ process monitoring system were available.

BRIEF SUMMARY OF THE INVENTION

Embodiments of the invention provide a novel technique for in situ monitoring of polishing processes and other removal processes. In an embodiment of the invention, a quartz crystal nanobalance is embedded in a wafer carrier or other fixture. During the polishing process, the material removed from the wafer or other target surface enters a surrounding slurry or solution and is deposited upon the surface of the quartz crystal nanobalance. The frequency of the quartz crystal nanobalance responds to the increased mass, yielding an indication of the amount of material removed. This indication can be processed to yield an instantaneous removal rate as well as endpoint detection. In response, the polishing parameters such as solution characteristics, down force, flow rate, etc., can be modified to adjust the instantaneous polishing rate. The endpoint indication identifies a point in the polishing process where a particular material has been substantially completely removed from the surface of the wafer.

The deposition on the quartz crystal nanobalance may be controlled in an embodiment of the invention by an applied bias. In this way, a user may select among possible materials to monitor. In addition, in a further embodiment of the invention, multiple quartz crystal nanobalances are embedded in the wafer carrier, allowing continuous and simultaneous monitoring of removal rates for different materials. In effect, it is possible to provide real time selective in situ monitoring using many embodiments of the invention. In an embodiment of the invention, one or more quartz crystal nanobalances are located remotely from the wafer carrier or other work piece, such as in a slurry conduit or reservoir.

In another embodiment of the invention, the quartz crystal nanobalance(s) is used to detect defect-causing events, such as a scratches, during the polishing process. In this embodiment of the invention, the quartz crystal nanobalance is in acoustic contact with the surface being polished. During a defect-causing event, additional acoustical noise is generated at the surface of the wafer and transferred to the quartz crystal nanobalance, often providing an additional noise frequency spike, detectable by the sensitive frequency monitoring equipment. This effect is detected and used to signal occurrence of a defect-causing event.

Additional features and advantages of the invention will be made apparent from the following detailed description of illustrative embodiments, which proceeds with reference to the accompanying figures.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION

The invention pertains to in situ monitoring of polishing processes, and encompasses, in embodiments of the invention, a novel system and technique for utilizing a nanobalance to perform such monitoring. In general overview, the nanobalance is used to monitor, in real time, a slurry or other liquid or semi-liquid environment or run-off, such as a polishing slurry. The response of the nanobalance is indicative of the rate at which material is being removed from the piece of interest. Other applications and arrangements are contemplated as well, as will be appreciated from the following description.

For the convenience of the reader, a brief description of quartz crystal nanobalance technology will be given, although this material will be familiar to those of skill in the art. A quartz crystal nanobalance is a piezoelectric quartz crystal that employs the converse piezoelectric effect to detect a mass change of the crystal. The quartz crystal nanobalance is fabricated of a thin slice of quartz, often with gold-coated electrodes on each side of the slice. The most common natural frequencies for such crystals are 5.000 MHz and 10.000 MHz, although other frequencies are sometimes used.

The sensitivity of determination of frequency of this apparatus can be as accurate as 0.1 Hertz, approximately corresponding to a 0.1 nanogram (ng) change in mass of a 20 $mm^2$ nanobalance electrode. In operation, a mass change results in a concurrent frequency change of the crystal. In greater detail, when material attaches to the surface of the crystal, it causes the crystal resonant frequency to drop, and the change in frequency is related to the change in mass. This can also be monitored by delta rather than absolute value for more sensitive measurements. For example, in an embodiment of the invention, the difference between the crystal resonant frequency and that of an unbiased reference crystal is tracked and used to more accurately determine mass changes in the primary crystal or crystals. Using this technique, mass changes on the order of nanograms can be detected. Commercial monitors are available for monitoring the frequency/mass of quartz crystals.

Figure 1:
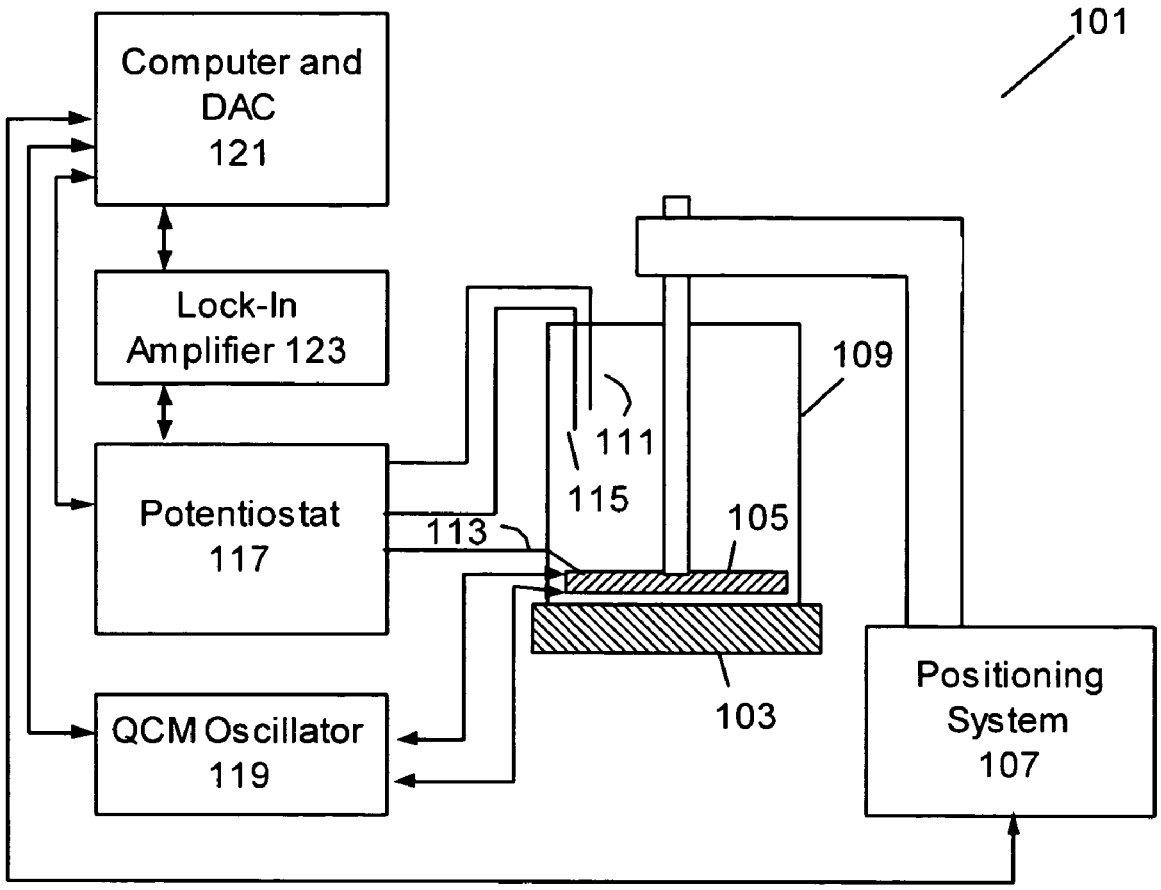
FIG. 1 is a schematic illustration of a processing system according to an embodiment of the invention.

Embodiments of the invention will now be described in greater detail with reference to the accompanying drawings. Referring to FIG. 1, a schematic illustration of a processing system 101 according to an embodiment of the invention is shown. In greater detail, the system 101 comprises a polishing tool 103 adjacent to a work assembly 105. As will be described by reference to later figures, the assembly 105 comprises a support (e.g. "head" or "wafer carrier") having mounted thereon a piece such as a wafer to be polished, as well as a quartz crystal.

The assembly 105 is preferably an accurately positionable assembly controlled by a positioning system 107. The positioning system 107 may control both the lateral position and the vertical position and/or pressure of the assembly 105. In an embodiment of the invention, the polishing tool 103 and the work assembly 105 reside within a cell 109, which is typically a container closed on at least the bottom and side surfaces to enable containment of a slurry or other material.

The cell 109 may further contain a reference electrode 111, a working electrode 113, and a counter electrode 115 as will be appreciated by those of skill in the art. The potential at the electrodes 111, 113, 115 is controlled and/or monitored by a potentiostat 117. The potential is applied and controlled in polishing processes to tune the polishing rate, and the reference electrode 111 aids in accurately controlling the potential. It will be appreciated that the innovations described herein can be employed for in situ monitoring of conventional CMP and ECMP processes, as well as other material removal processes. A QCM oscillator module 119 is connected to the quartz crystal nanobalance at the work assembly 105. The QCM oscillator module 119 is used to power the crystal and to analyze its resonant frequency as will be appreciated by those of skill in the art.

Finally, a Computer and DAC (digital-to-analog) module 121 is integrated into the system 101. The Computer and DAC module 121 serves many purposes in an embodiment of the invention, including (1) monitoring the quartz crystal nanobalance via the QCM oscillator module 119, (2) monitoring and controlling the positioning system 107, (3) monitoring the potentiostat 117, and (4) controlling the potentiostat 117 via a lock-in amplifier 123.

In brief overview, to be expanded upon later, the illustrated configuration 101 allows accurate monitoring and control of a polishing process. In particular, as material is removed from the piece of interest during polishing, it is deposited upon the quartz crystal nanobalance, changing its frequency. In this manner, the rate of polishing can be monitored. This enables real-time fine-tuning of the polishing rate and also aids in identifying significant changes in the process, such as when removal of a particular layer is complete. In particular, this real-time process monitoring is used in an embodiment of the invention as a means to deliver real time process control through feedback of the polishing status to modify control parameters, e.g. solution characteristics, down force, etc.

Figure 2:
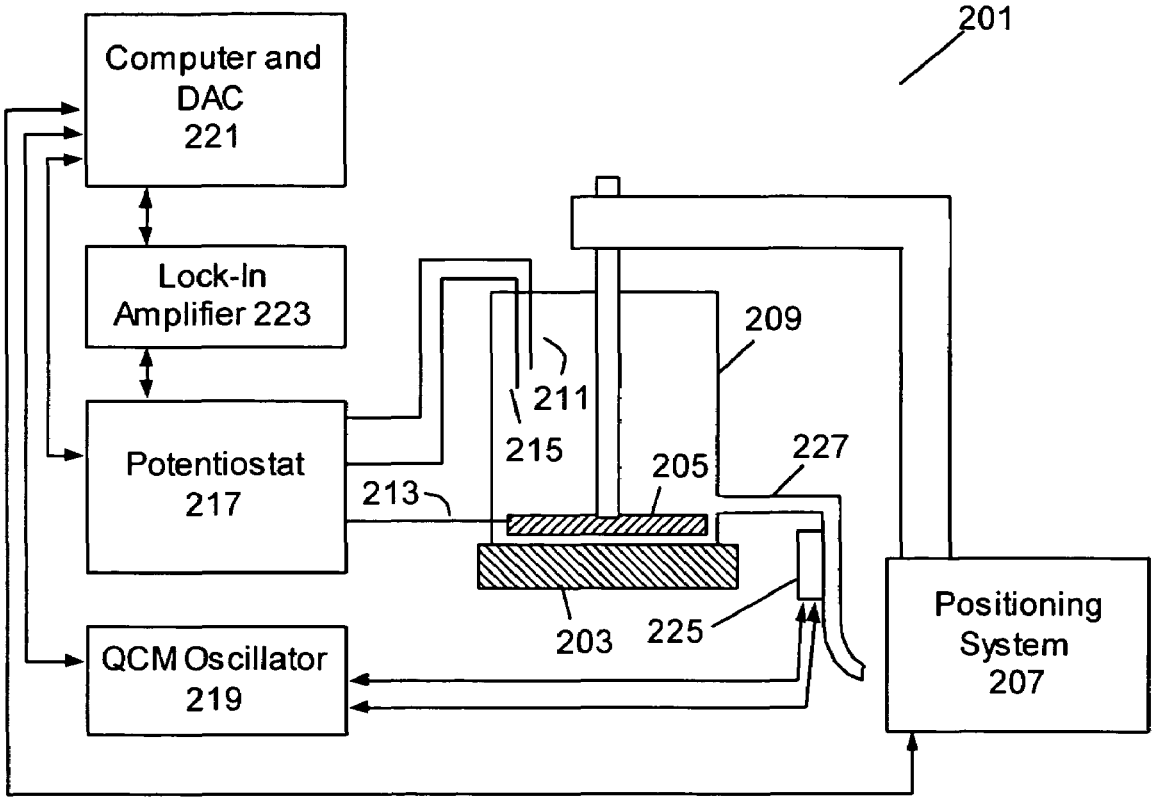
FIG. 2 is a schematic illustration of a processing system according to an alternative embodiment of the invention.

FIG. 2 is a schematic illustration of an alternative configuration according to an alternative embodiment of the invention. In particular, the system 201 comprises many of the same elements as FIG. 1. That is, the system 201 comprises a polishing tool 203 adjacent to a work assembly 205, and a positioning system 207. Moreover, the system 201 comprises a cell 209 containing a reference electrode 211, a working electrode 213, and a counter electrode 215, as well as a potentiostat 217. A QCM oscillator module 219 is connected as described above and a Computer and DAC (digital-to-analog) module 221 is similarly integrated into the system 201.

However, the configuration shown in FIG. 2 is distinct from that shown in FIG. 1 with respect to the positioning of the quartz crystal nanobalance. In particular, the assembly 205 comprises a support having mounted thereon a piece of interest, but may or may not incorporate a quartz crystal nanobalance. Rather, a quartz crystal nanobalance 225 is located at a remote site such as in a drainage line or reservoir 227 for the cell 209. In this case, although the crystal 225 is not acoustically coupled to the work assembly 205 or the wafer etc. of interest, it is still in contact with the slurry, and hence can still receive polishing byproducts.

Figure 3A:
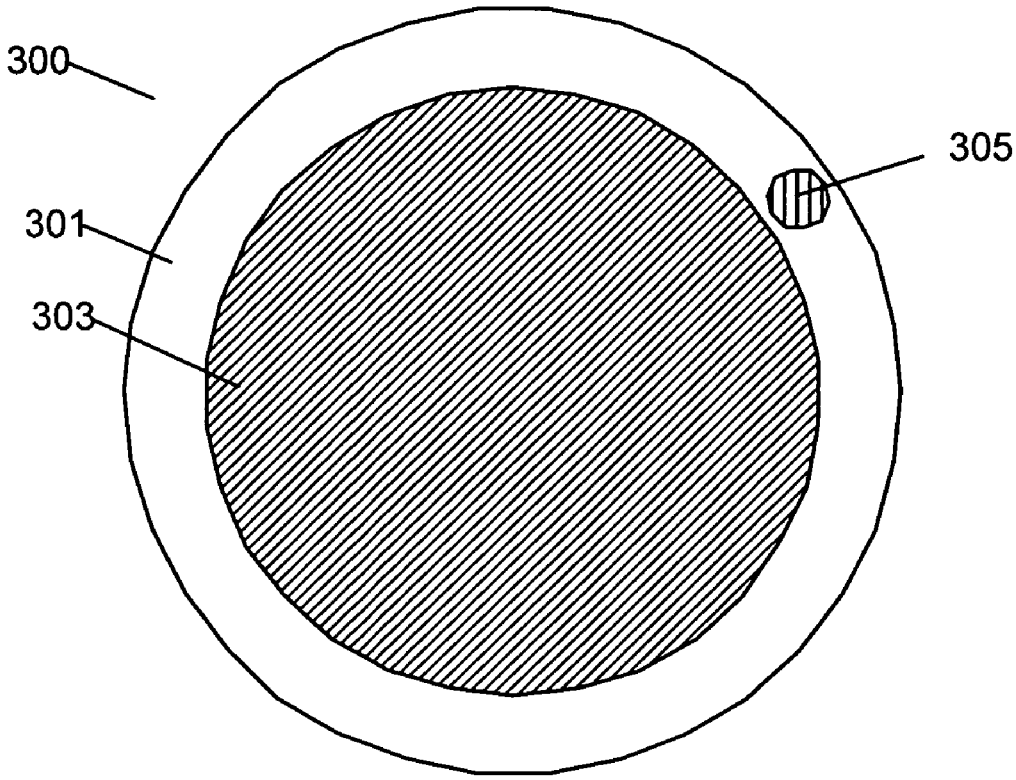
FIG. 3A is a top view of a wafer mount and crystal according to an embodiment of the invention.
Figure 3B:
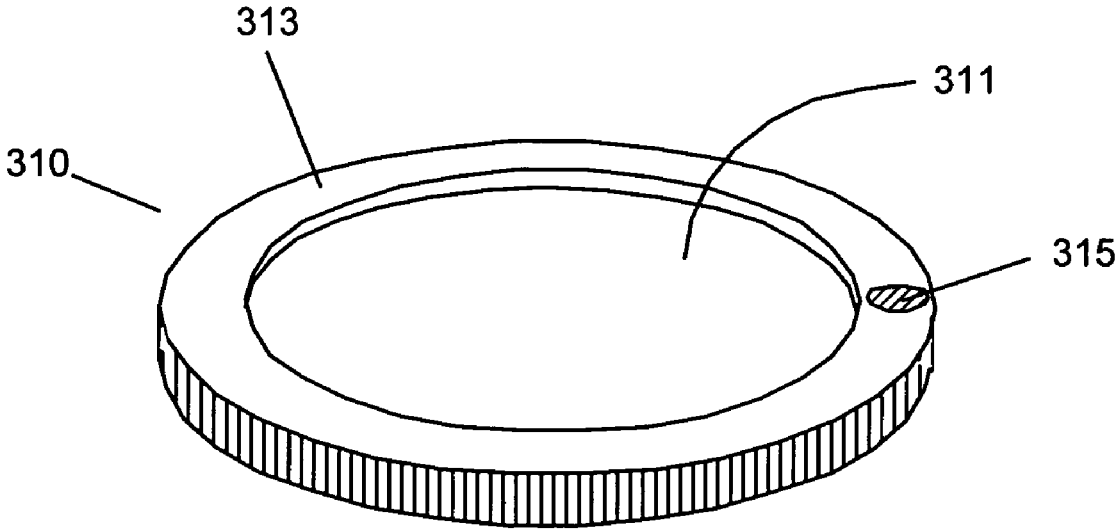
FIG. 3B is a perspective side view of a wafer mount and crystal according to an embodiment of the invention.
Figure 4:
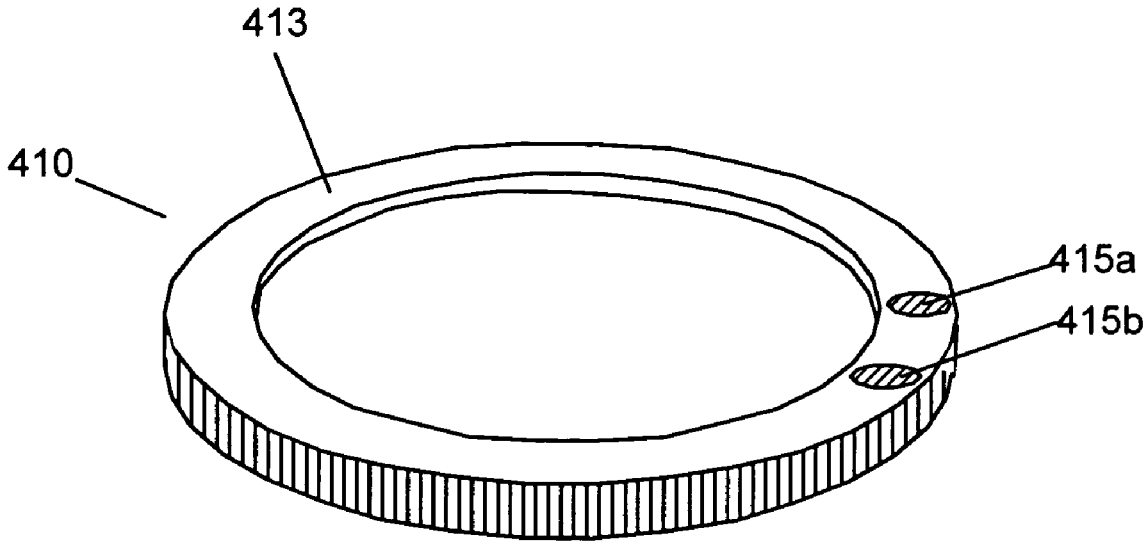
FIG. 4 is a perspective side view of a wafer mount and crystal according to an alternative embodiment of the invention.

Work assemblies in accordance with embodiments of the invention are illustrated in FIGS. 3 and 4. In particular, FIG. 3A illustrates in schematic top view a work assembly 300 according to an embodiment of the invention usable in conjunction with the embodiment of the invention shown in FIG. 1 (205). The work assembly 300 comprises a wafer carrier 301, a wafer 303 to be processed, and a quartz crystal nanobalance 305 embedded in the wafer carrier 301. The wafer 303 is retained in the wafer carrier 301 via a retaining ring. The quartz crystal nanobalance 305 is embedded in the retaining ring portion of the wafer carrier 301. This feature may be more clearly seen in FIG. 3B, which illustrates the work assembly 300 in perspective side view with the wafer 303 removed.

Referring now to FIG. 3B, the wafer carrier 310 comprises a central recess 311 for holding a wafer for processing. A retaining ring 313 surrounding the recess 311 is used to hold a wafer to the wafer carrier 310 for processing. According to an embodiment of the invention, a quartz crystal nanobalance 315 is embedded in the retaining ring 313 of the wafer carrier 310. In this embodiment of the invention, the quartz crystal 315 may be in acoustic contact with a wafer that is placed in the central recess 311, as will be discussed below.

A salient feature of the above-described embodiments of the invention is the ability to tune the response of the quartz crystal nanobalance to react to particular materials. In particular, in an embodiment of the invention, a voltage bias is applied to the quartz crystal nanobalance to stimulate mass deposition by, for example, reducing ions at the electrode surface. Different biases can result in different reactions. For example, a bias of x volts will allow the deposition of copper on the surface of the quartz crystal nanobalance, while a bias of y volts will allow the deposition of tantalum on the surface of the quartz crystal nanobalance. Moreover, the applied bias may be dynamically varied during the polishing operation to obtain the instantaneous rate of removal of particular materials.

The preceding mechanism for monitoring the removal rates of multiple materials allows one to check the instantaneous rate of removal, but does not allow the measurement of overall removal amount of a particular material since the quartz crystal nanobalance is sometimes tuned to a different material. In an embodiment of the invention, the simultaneous continuous monitoring of the removal rates of multiple materials is provided by incorporating multiple quartz crystal nanobalances into the wafer carrier (or slurry waste reservoir or conduit). Such an arrangement is illustrated in perspective side view in FIG. 4. In particular, the retaining ring 413 of the wafer carrier 410 incorporates both a first quartz crystal nanobalance 415*a* as well as a second quartz crystal nanobalance 415*b*. Both quartz crystal nanobalances 415*a*, 415*b* are independently biased and monitored, such as by the QCM Oscillator module 119 of FIG. 1. It will be appreciated that various alternative arrangement are possible including but not limited to having one or more embedded crystals in addition to one or more remote crystals (e.g., as shown in FIG. 2).

In an embodiment of the invention, the observed deposition differences between crystals having different biases can be used to more precisely determine a desired deposition rate. For example, assume that material x will deposit on the surface of a crystal with an applied bias of −0.5V or less, while material y will deposit on the surface of the crystal with an applied bias in a range of −1V or less. During the polishing of a surface that comprises material x and material y, a portion of the both removed materials will soon be located adjacent to the crystals through ordinary flow and/or diffusion. If a bias slightly more negative than −1V is applied, the rate of deposition at the crystal (mirroring the rate of removal at the wafer) will reflect the rates for both materials.

In order to attribute a fraction of the observed rate to a material of interest, e.g. material y, it is useful to know the rate of deposition solely of material x. In a multiple crystal apparatus as shown in FIG. 4, this may be done by applying different biases to different crystals, and subtracting, from the observed rate at one crystal, the observed rate at the other crystal. In the foregoing example, a crystal biased at −1.02V will respond to both materials while a crystal biased at −0.99V will respond only to material x. Thus the observed rate at the first crystal (biased at −1.02V) can be decreased by the amount of deposition calculated for the second crystal (biased at −0.99V) to yield a truer indication of the rate of deposition (and hence polishing) of material y. In an apparatus having only a single crystal, time division may be used instead.

The rates of deposition of materials are often bias dependent, and thus the rate of deposition of material x on the −0.99V crystal will be slightly less than the portion of deposition on the −1.02V crystal attributable to material x. This difference will be minimal however. In addition, the deposition rate dependence on bias voltage may be calibrated against beforehand.

With respect to the foregoing example materials, using a time division technique instead, during a first interval the crystal is biased at −0.99V, and reflects the deposition rate of material x. During a second interval, the crystal is biased at −1.02V, and reflects the combined deposition rate for material x and material y. However, the deposition rate for material y may then be obtained by subtracting, from the combined rate, the known rate for material x.

Prior to describing process monitoring techniques in detail according to various embodiments of the invention, a brief overview of types of monitoring processes will be given. Three primary types of monitoring include (1) instantaneous removal rate monitoring, (2) defect monitoring, and (3) end-point monitoring. The premise and relevant mechanisms for each will be described with reference to FIGS. 5A–5C.

Figure 5A:
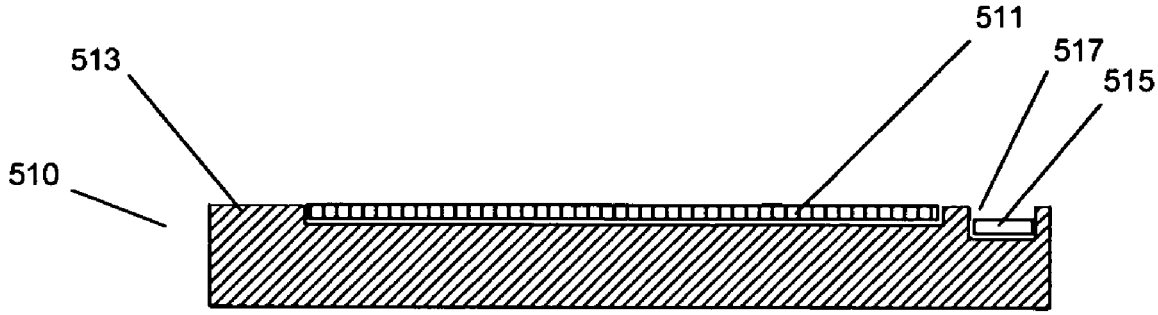
FIG. 5A is a cross-sectional side view of a wafer mount, wafer, and crystal according to an embodiment of the invention.
Figure 5B:
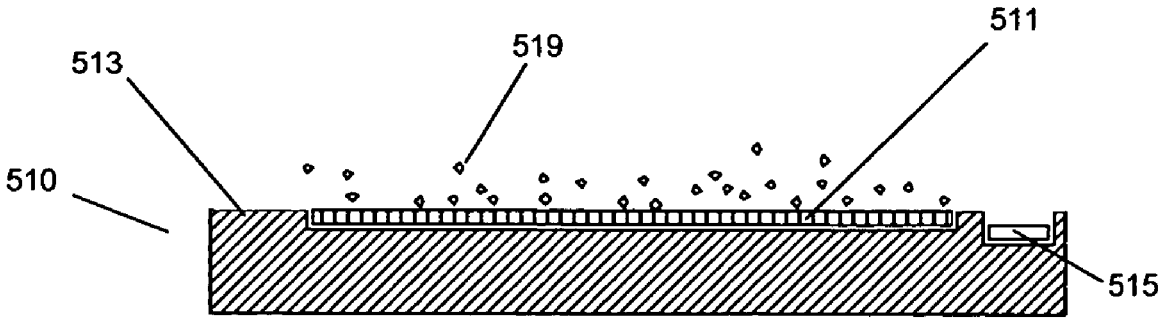
FIG. 5B is a cross-sectional side view of a wafer mount, wafer, and crystal according to an embodiment of the invention wherein material has been removed from the surface of the wafer.

FIG. 5A is a cross-sectional side view of a work assembly 510 according to an embodiment of the invention. As discussed above, the work assembly 510 comprises a retaining ring 513 for holding a wafer 511. The retaining ring 513 further comprises a recess 517 for holding a quartz crystal nanobalance 515. The quartz crystal nanobalance 515 may be secured in place via an acoustically coupling adhesive, although for most embodiments of the invention any traditional adhesive or fastener is suitable. In addition, the recess 517 for holding the quartz crystal nanobalance 515 may be recessed sufficiently that the surface of the quartz crystal nanobalance 515 does not extend to the upper surface of the work assembly 510. In this manner, the polishing mechanism acting upon the wafer 511 does not directly affect the quartz crystal nanobalance 515.

During the polishing process, material removed from the surface of the wafer 511 enters the surrounding slurry or solution. This state is illustrated schematically in FIG. 5B. In particular, metal ions 519, are shown as having been separated from the surface of the wafer 511 by the polishing process, and are sited in the slurry or solution. It may also be possible to induce larger entities to accumulate on the surface of the crystal, so that, e.g., dissolved high-surface charge colloidal particles can be monitored. It may also be possible to monitor nonconductive material removal rates if they are induced to form charged colloidal particles in solution. Materials that may be removed during polishing include, but are not limited to, copper, tantalum, nickel, tungsten, iron, interlevel dielectric, and shallow trench dielectric, with the metallic materials being in ionic form when removed. It will be appreciated that the ions 519 are shown much larger than scale to aid visibility.

Figure 5C:
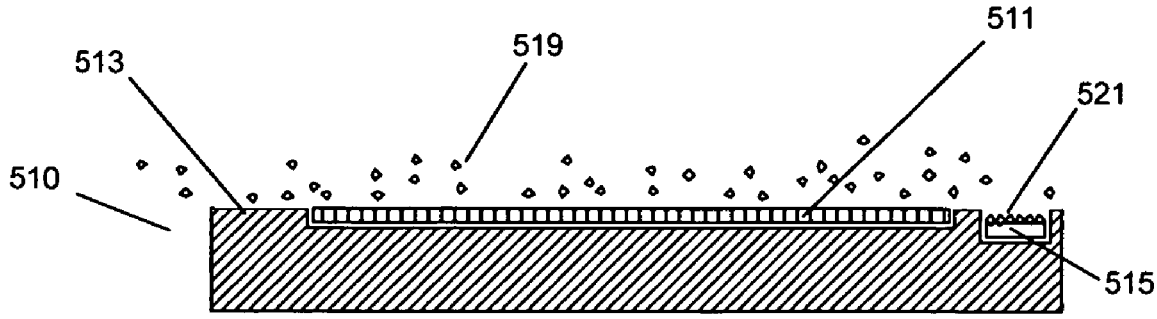
FIG. 5C is a cross-sectional side view of a wafer mount, wafer, and crystal according to an embodiment of the invention wherein the material that has been removed from the surface of the wafer is deposited on the crystal.

FIG. 5C illustrates schematically the state of the system at a subsequent point in time. At this point in time, some of the metal ions 519 have migrated to the vicinity of the quartz crystal nanobalance 515 and have deposited upon the surface thereof, either through physical, electrochemical, or other mechanisms. This particular group is indicated by reference 521. Due to the deposit of material 521 on the surface of the quartz crystal nanobalance 515, the resonant frequency of the crystal 515 is altered in a manner well understood by those of skill in the art.

This change in frequency is monitored to gauge the amount of material deposited. The amount of material deposited during a given period is generally proportional to the amount of material removed from the surface of the wafer 511 at about that same time. Note that the response of the crystal is typically within milliseconds of the corresponding removal event at the wafer 511 surface. Thus, the change in frequency of the crystal can be used to track in real time the removal rate of material from the wafer 511.

An additional application of this effect is to detect the endpoint of the polishing process for a particular material. For example, if copper is being removed from the wafer 511 and the crystal 515 is responsive to copper (e.g., the bias is appropriate for deposition of copper), then the crystal frequency will show a progressive change as copper is removed from the wafer 511, followed by a plateau in frequency when all of the copper has been removed.

Figure 6:
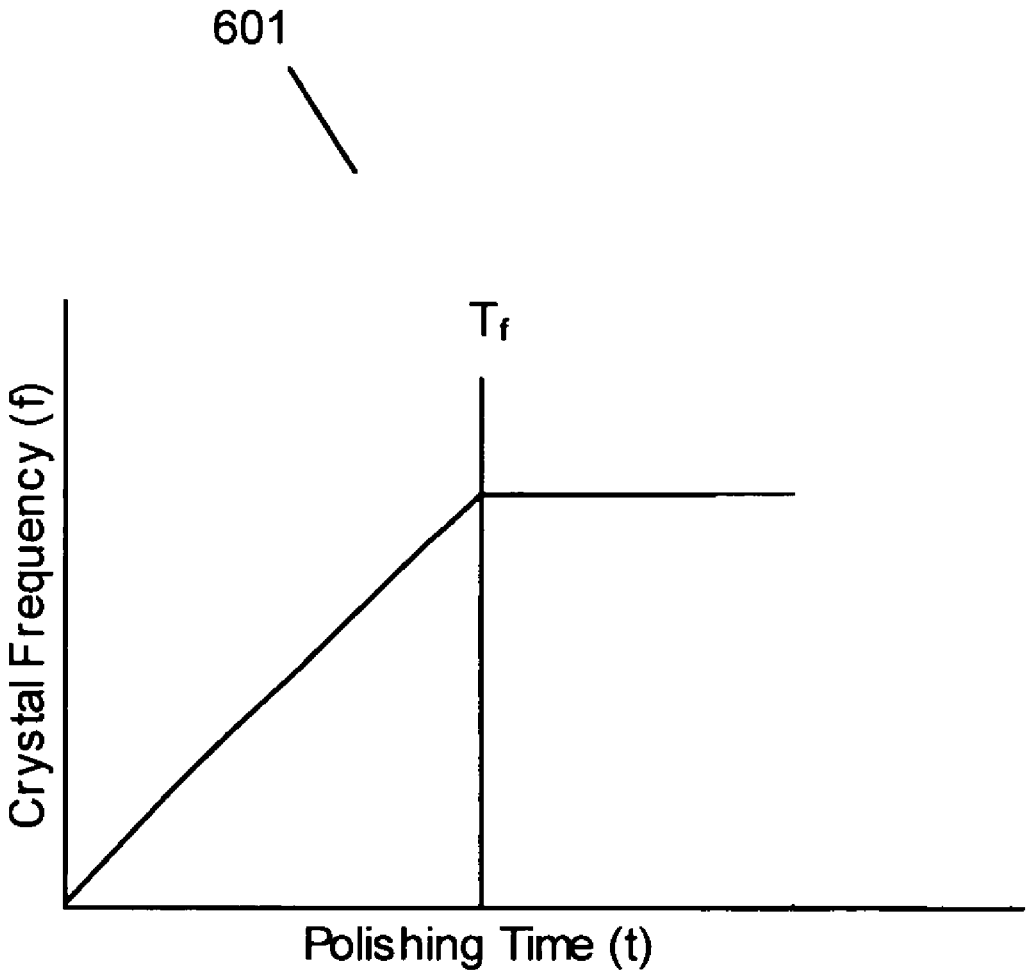
FIG. 6 illustrates a simulated data plot showing polishing time versus crystal frequency for an embodiment of the invention.

The simulated plot 601 of FIG. 6 illustrates this interrelationship. In particular, the horizontal axis represents polishing time elapsed in arbitrary units, while the vertical axis represents crystal frequency, also in arbitrary units, shifted to start at zero. As can be seen, between the start of the process and time $T_f$, the frequency of the crystal changes in a linearly increasing manner. This is indicative of a constant rate of accumulation on the crystal, and thus a constant rate.

At time $T_f$, the rate of change of the crystal frequency drops to zero, resulting in a flat frequency plot. This is indicative of no accumulation on the crystal of the species that the crystal is biased for, and thus of no removal of that species from the wafer or other treatment surface. Thus, the time $T_f$ represents the endpoint of the polishing process for the material of interest.

It will be appreciated that the graph is exemplary only and that the observed removal rate may not be constant. The invention also includes and indeed is well-adapted for evaluating non-constant rates. For example, during polishing of certain materials, e.g. copper, there is an initiation period during which there is a lower polish rate. It is useful to track the removal rate, end point, etc. relative to this period, and the described mechanisms can be beneficially used for such purposes as well.

Note that the actual frequency response of the quartz crystal nanobalance may have to be calibrated to display the characteristics shown in FIG. 6. For example, when changes in frequency response are due to two species, one of which cannot be selected out (e.g., its deposition on the crystal cannot be controlled by applying bias), the contribution from that species may be mathematically removed to show the contribution due only to the other species. Alternatively, instead of noting the endpoint as a plateau, the endpoint can be detected by watching for a spike or substantial change in the second derivative of the crystal time/frequency data. Such a spike would indicate that the rate of accumulation has abruptly changed.

While the above techniques for endpoint detection and rate monitoring can be performed with the crystal either in or remote from the wafer carrier, the technique of defect detection is preferably executed with the crystal in acoustic contact with the wafer. In the arrangement shown, for example, in FIGS. 3A–5C, the acoustic link between the crystal and the wafer is via the wafer carrier. In addition, the crystal may be adhered to the wafer carrier with an acoustically conductive adhesive. In this embodiment of the invention, when an abnormally large abrasion occurs during the polishing process, such as due to a granular impurity in the slurry, the resulting acoustic disturbance is detected by the crystal as a momentary perturbation in its frequency.

Figure 7:
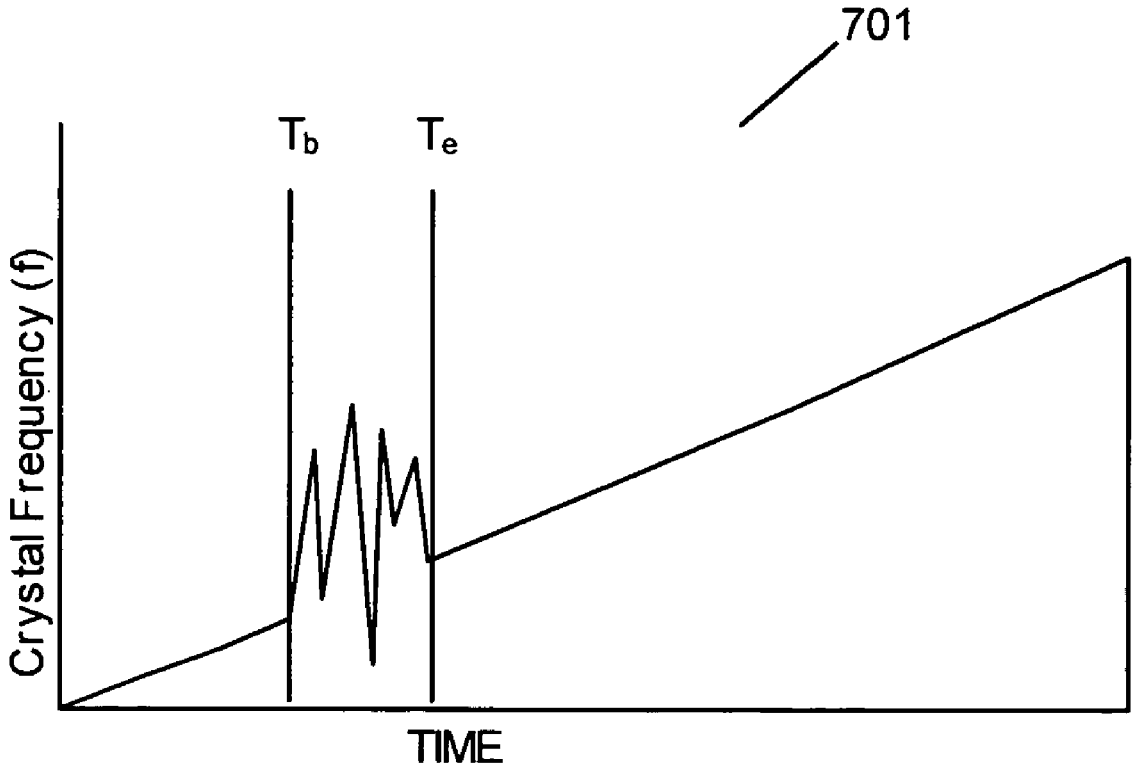
FIG. 7 illustrates a simulated data plot showing polishing time versus crystal frequency for a further embodiment of the invention.

FIG. 7 illustrates a simulated plot of frequency data during a scratch event. The horizontal axis represents time, while the vertical axis represents crystal frequency. The scratch event begins at time $T_b$ and ends at time $T_e$. The frequency of the crystal during the scratch is noisy and sporadic compared to the surrounding portions of the plot where the frequency is smooth. Thus, the presence of sudden deviations in the crystal frequency can be used to detect the occurrence of such defect-causing events.

Figure 8:
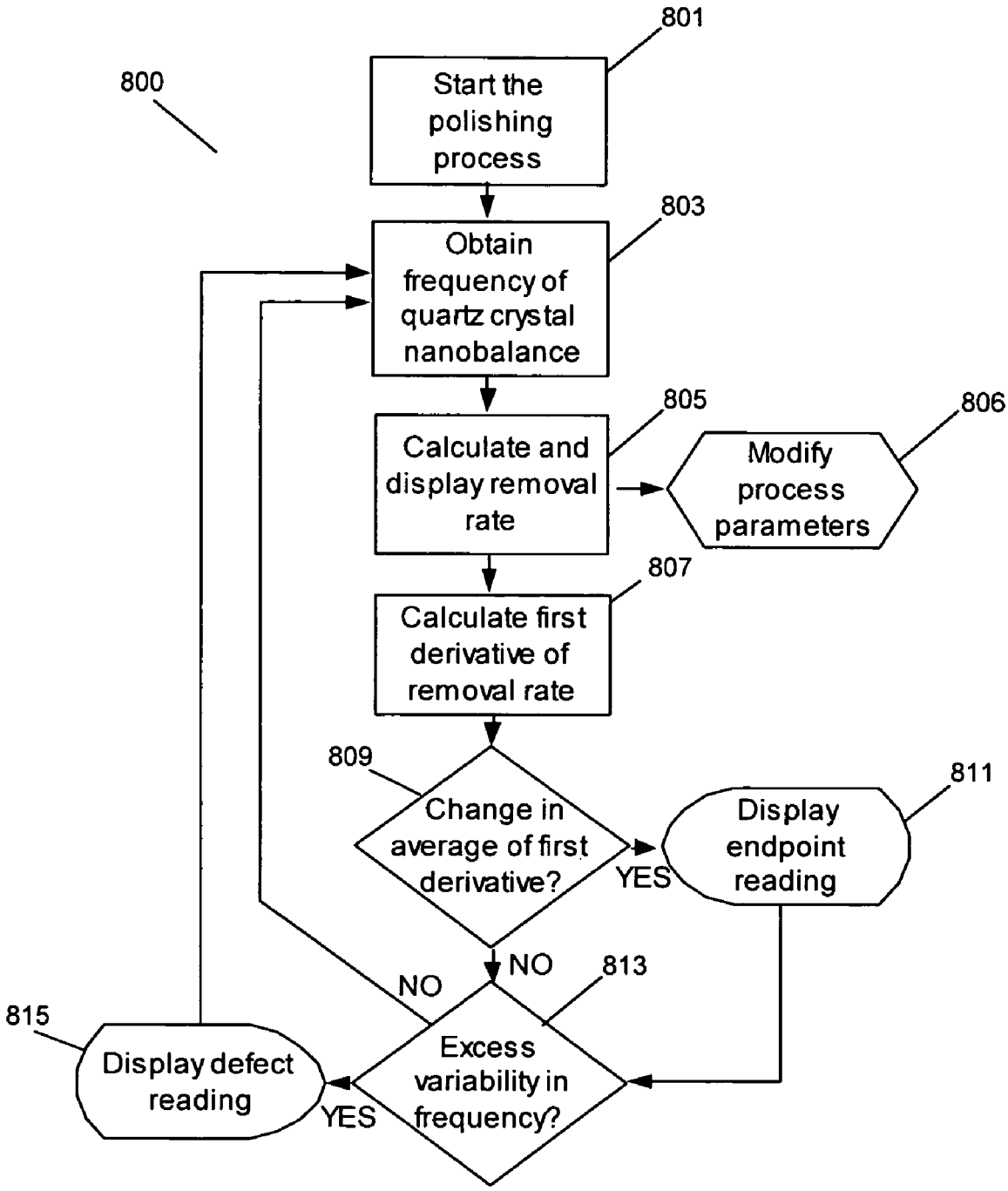
FIG. 8 illustrates a flow chart showing a process for monitoring a polishing process according to an embodiment of the invention.

FIG. 8 illustrates in flow chart form a method of monitoring a polishing process according to an embodiment of the invention. It will be appreciated that the illustrated process is but one way of using the innovations described herein, and other monitoring methodologies may be used as well. The illustrated method involves monitoring to detect defects, to identify the process endpoint, and to assess the instantaneous removal rate. The apparatus used in the method comprises a wafer, a wafer carrier, and an integral quartz crystal nanobalance, although all of the monitoring aspects except defect monitoring could also be performed using a remote nanobalance.

In step 801 of the flow chart 800, the polishing process is started. This typically comprises lowering a wafer or other item to be polished, held by the polishing tool, into contact at some predetermined downforce with the polishing pad. In addition, rotating and/or reciprocating movement of the pad and/or wafer carrier may be commenced. At step 803, the resonant frequency of the quartz crystal nanobalance is obtained, and in step 805 a removal rate is calculated and displayed. As discussed above, the removal rate is based upon the change in frequency, i.e., from a prior time period. At step 806, the polishing process parameters may be modified, either automatically or manually, to alter the removal rate if necessary.

In addition, at step 807, the first derivative of the removal rate is calculated. It is determined at step 809 whether a substantial change in the average of the first derivative has occurred. The use of the average value is to eliminate the effects of noise. For example, the first derivative may be averaged over the preceding 5 time intervals, or whatever lesser number of intervals are available. If the determination finds that a substantial change in the average of the first derivative has occurred, then at step 811, an endpoint reading is displayed, signaling a user that the endpoint of the polishing process has been reached. After step 811, the process flows to step 813. If instead it is determined that a substantial change in the average of the first derivative has not occurred, then the process flows directly to step 813 from step 809.

At step 813, the process determines whether there is excess variability in the frequency over time. This may be determined by identifying a sharp increase in deviation of frequency measurements from the current average, whether or not the average itself changes. The degree of increase is left to user preference, but an increase of an order of magnitude is typically sufficient to indicate the occurrence of a defect-causing event such as a scratch. If it is determined that there is excess variability in the frequency overtime, then the process flows to step 815, where a defect reading is displayed, and the process returns to step 803. Otherwise, the process flows directly to step 803.

It will be appreciated that new and useful process monitoring methods and apparatuses have been described herein. In view of the many possible embodiments to which the principles of this invention may be applied, it should be recognized that the embodiments described herein with respect to the drawing figures are meant to be illustrative only and should not be taken as limiting the scope of invention. For example, those of skill in the art will recognize that the precise configurations and shapes shown are exemplary and that the illustrated embodiments can thus be modified in arrangement and detail without departing from the spirit of the invention.

Therefore, the invention as described herein contemplates all such embodiments as may come within the scope of the following claims and equivalents thereof.

What is claimed is:

1. A method for monitoring a polishing process comprising the steps of:

performing a polishing process with respect to a target surface within a cell, whereby a target material is removed from the target surface;

during the polishing process, collecting at least a portion of the removed target material on the surface of a resonant body within the cell, the resonant body having a resonance frequency, thereby modifying the resonance frequency of the resonant body; and determining the value of the resonance frequency during the monitoring process.

2. The method according to claim 1, further comprising determining that the rate of change of the resonance frequency of the resonant body has substantially changed and signaling that substantially all of the target material has been removed from the target surface.

3. The method according to claim 1, wherein the step of collecting at least a portion of the removed target material on the surface of the resonant body is performed in situ.

4. The method according to claim 1, wherein the resonant body is a quartz crystal nanobalance.

5. The method according to claim 4, wherein the target material is metal, and the removed material is in the form of metal ion.

6. The method according to claim 5, wherein the quartz crystal nanobalance is gold plated, and wherein the step of collecting at least a portion of the removed target material on the surface of the resonant body further comprises applying a negative voltage to the quartz crystal nanobalance with respect to a reference electrode.

7. The method according to claim 1, further comprising providing a second resonant body for monitoring the removal of second target material.

8. The method according to claim 7, wherein the step of collecting at least a portion of the removed target material on the surface of the resonant body further comprises collecting at least a portion of the removed target material on the surface of the second resonant body.

9. A computer-readable medium having thereon computer-executable instructions for performing a method of detecting an endpoint of a chemical mechanical polishing process, comprising the steps of:

during the chemical mechanical polishing process, periodically checking a resonance frequency of a resonant body to determine a rate of change of the frequency, wherein the chemical mechanical polishing process causes material removed from a target surface to be deposited on the surface of the resonant body, and wherein the resonant frequency of the resonant body is related to the amount of removed material deposited on the surface of the resonant body;

detecting a variation in the rate of change in frequency of the resonant body; and if the variation in the rate of change of the frequency exceeds a predetermined threshold, signaling the endpoint of the chemical mechanical polishing process.

10. The computer-readable medium according to claim 9, wherein the resonant body is a quartz crystal nanobalance.

11. The computer-readable medium according to claim 10, wherein the material removed from a target surface is selected from the group consisting of copper, tantalum, tungsten, nickel, and iron, and wherein the removed material is in ionic form once removed.

12. An apparatus for performing a chemical mechanical polishing process comprising:

a cell for performing the chemical mechanical polishing process;

a target surface mounted within the cell;

a resonant crystal mounted within the cell, wherein the resonant crystal is situated and configured to collect on its surface at least a portion of the material removed from the target surface during the chemical mechanical polishing process whereby a resonance frequency of the resonant crystal is altered; and a monitor for collecting data comprising a plurality of periodic samples of the resonance frequency of the resonant crystal and for detecting an endpoint of the chemical mechanical polishing process based on the collected data.

13. The apparatus according to claim 12, wherein the monitor is further adapted to provide an endpoint output signal.

14. The apparatus according to claim 13, further comprising an automated controller for controlling the chemical mechanical polishing process, and for automatically stopping the chemical mechanical polishing process in response to the endpoint output signal.

15. A method for detecting a defect during a polishing process comprising the steps of:

performing a polishing process with respect to a target surface within a cell, whereby a target material is removed from the target surface;

providing an acoustic contact between the target surface and a resonant body having a resonant frequency;

during the polishing process, monitoring, the resonant frequency of the resonant body; and determining based on characteristics of the resonant frequency of the resonant body that a defect event has occurred.

16. The method according to claim 15, wherein the resonant body is a quartz crystal nanobalance.

17. The method according to claim 16, wherein the target material is metallic.

18. The method according to claim 16, wherein the target material is nonmetallic.

19. A computer-readable medium having thereon computer-executable instructions for performing a method of detecting a scratch during a polishing process, comprising the steps of:

during the polishing process, periodically checking a resonance frequency of a resonant body that is acoustically coupled to a target surface to determine variability of the frequency;

detecting a substantially increased variability in the frequency of the resonant body; and if the increase in variability in the frequency of the resonant body exceeds a predetermined threshold, signaling that a scratch has occurred during the polishing process.

20. The computer-readable medium according to claim 19, wherein the resonant body is a quartz crystal nanobalance.

21. The computer-readable medium according to claim 20, wherein the material removed from the target surface is selected from the group consisting of copper, tantalum, nickel, tungsten, iron, interlevel dielectric, and shallow trench dielectric.

22. An apparatus for performing a polishing process comprising:

a cell for performing the polishing process;

a target surface mounted within the cell;

a resonant crystal mounted within the cell; and a monitor for collecting data comprising a plurality of periodic samples of the resonance frequency of the resonant crystal and for detecting an anomaly during the polishing process based on the collected data.

23. The apparatus according to claim 22, wherein the target surface and the resonant crystal are acoustically coupled.

24. The apparatus according to claim 22, wherein the target surface and the resonant crystal are acoustically decoupled.

25. The apparatus according to claim 22, wherein the monitor is further adapted to provide an anomaly output signal.

26. The apparatus according to claim 25, further comprising an automated controller for controlling the polishing process, and for automatically stopping the polishing process in response to the anomaly output signal.

27. A method for measuring a real-time rate of material removal during a polishing process comprising the steps of:

performing a polishing process with respect to a target surface within a cell, whereby a target material is removed from the target surface;

during the polishing process, collecting at least a portion of the removed target material on the surface of a resonant body within the cell, the resonant body having a resonance frequency, thereby modifying the resonance frequency of the resonant body; and determining based on the rate of change of the resonance frequency of the resonant body the real-time rate of material removal from the target surface.

28. The method according to claim 27, wherein the resonant body is a quartz crystal nanobalance.

29. The method according to claim 28, wherein the target material is selected from the group consisting of copper, tantalum, nickel, tungsten, iron, interlevel dielectric, and shallow trench dielectric.

30. The method according to claim 29, wherein the quartz crystal nanobalance is gold plated, and wherein the step of collecting at least a portion of the removed target material on the surface of the resonant body further comprises applying a negative potential to the quartz crystal nanobalance relative to the potential of a reference electrode.

31. A computer-readable medium having thereon computer-executable instructions for performing a method of measuring a real-time rate of material removal during a polishing process, comprising the steps of:

during the polishing process, periodically checking a resonance frequency of a resonant body to determine a rate of change of the frequency, wherein the polishing process causes material removed from a target surface to be deposited on the surface of the resonant body, and wherein the resonant frequency of the resonant body is related to the amount of removed material deposited on the surface of the resonant body;

detecting a rate of change in frequency of the resonant body; and determining, based on the rate of change of the frequency, the real-time rate of removal of material from the target surface during the polishing process.

32. The computer-readable medium according to claim 31, wherein the resonant body is a quartz crystal nanobalance.

33. The computer-readable medium according to claim 32, wherein the material removed from the target surface is selected from the group consisting of copper, tantalum, tungsten, nickel, and iron, and wherein the removed material is in ionic form once removed.

34. An apparatus for measuring a real-time rate of material removal during a polishing process comprising:

a resonant crystal mounted within a polishing cell having therein a target surface from which material is to be removed during polishing, wherein the resonant crystal is situated and configured to collect on its surface at least a portion of the material removed from the target surface during the polishing process whereby a resonance frequency of the resonant crystal is altered; and a monitor for collecting data comprising a plurality of periodic samples of the resonance frequency of the resonant crystal and for determining, based on the collected data, the real-time rate of material removal from the target surface.

35. The apparatus according to claim 34, wherein the monitor is further adapted to provide an output signal identifying the determined rate of material removal.

36. The apparatus according to claim 35, further comprising an automated controller for controlling the polishing process, and for automatically modifying at least one parameter of the polishing process in response to the output signal.

* * * * *